US012458867B1

(12) United States Patent
Simon

(10) Patent No.: US 12,458,867 B1
(45) Date of Patent: Nov. 4, 2025

(54) SKI BRACKET SYSTEM

(71) Applicant: Chris Stevens Simon, Los Angeles, CA (US)

(72) Inventor: Chris Stevens Simon, Los Angeles, CA (US)

( * ) Notice: Subject to any disclaimer, the term of this patent is extended or adjusted under 35 U.S.C. 154(b) by 0 days.

(21) Appl. No.: 19/280,196

(22) Filed: Jul. 25, 2025

(51) Int. Cl.
*A63C 9/00* (2012.01)

(52) U.S. Cl.
CPC ..... *A63C 9/003* (2013.01)

(58) Field of Classification Search
CPC ..... A63C 9/003
See application file for complete search history.

(56) References Cited

U.S. PATENT DOCUMENTS 3,606,369 A * 9/1971 Batal ..... A63C 9/0847 280/634
3,909,025 A * 9/1975 Gertsch ..... A63C 9/007 280/618
3,918,732 A * 11/1975 Wulf ..... A63C 9/0847 280/613
4,526,397 A * 7/1985 Richert ..... A63C 9/007 280/612
4,741,550 A * 5/1988 Dennis ..... A63C 10/26 280/14.23
5,071,154 A * 12/1991 Szasz ..... A63C 9/005 280/625
5,129,668 A * 7/1992 Hecht ..... A63C 9/007 280/607
5,395,132 A * 3/1995 Abondance ..... A63C 9/00 280/607
5,513,872 A * 5/1996 Arduin ..... A63C 5/07 280/634
5,671,939 A * 9/1997 Pineau ..... A63C 5/075 280/607
6,217,055 B1 * 4/2001 Silva ..... A63C 9/003 280/607
6,283,493 B1 * 9/2001 Arduin ..... A63C 9/003 280/634
6,523,851 B1 * 2/2003 Maravetz ..... A63C 5/02 280/14.22
6,648,362 B1 * 11/2003 Bunter ..... A63C 9/003 280/607
6,773,024 B2 * 8/2004 Walkhoff ..... A63C 7/1053 280/634
8,328,225 B2 * 12/2012 Prigge ..... A63C 9/0807 280/614
9,937,407 B2 * 4/2018 Kloster ..... A63C 5/031
11,583,753 B2 * 2/2023 Stanek ..... A63C 5/031
11,697,057 B2 * 7/2023 Surdy ..... A63C 9/086 280/611
2002/0105167 A1 * 8/2002 Mercier ..... A63C 9/003 280/611

(Continued)

*Primary Examiner* — Erez Gurari
(74) *Attorney, Agent, or Firm* — Plager Schack LLP; Mark H. Plager; Naomi Mann

(57) ABSTRACT

A ski binding system includes a binding support configured to support a toe piece and a heel piece of the ski binding system on a ski, wherein the bindings support includes at least one bindings support plate to which the toe piece and the heel piece are attached, wherein the at least one bindings support plate is maintained in parallel position to the ski under spring tension, and is configured to tilt when subjected to a tilting force to allow the ski bindings to sway, said tilting force being against the spring tension.

10 Claims, 3 Drawing Sheets

(56) References Cited

U.S. PATENT DOCUMENTS

| | | | | |
|---|---|---|---|---|
| 2004/0041365 | A1* | 3/2004 | Humbel | A63C 10/18<br>280/618 |
| 2006/0232045 | A1* | 10/2006 | Schary | A63C 9/003<br>280/617 |
| 2009/0071019 | A1* | 3/2009 | Pupko | A43B 5/04<br>600/587 |
| 2013/0056960 | A1* | 3/2013 | Chickering-Ayers | A63C 9/0847<br>280/623 |
| 2016/0199722 | A1* | 7/2016 | Ritter | A63C 9/02<br>280/617 |

* cited by examiner

SKI BRACKET SYSTEM

BACKGROUND

The present disclosure relates generally to ski equipment, and more specifically to ski binding systems.

Conventional ski binders may be too rigid, which may affect turning and speed. As such, an improved system is desirable.

SUMMARY

According to various embodiments, disclosed is a ski binding system which may comprise a binding support configured to support a toe piece and a heel piece of the ski binding system on a ski, wherein the bindings support includes at least one bindings support plate to which the toe piece and the heel piece are attached, wherein the at least one bindings support plate is maintained in parallel position to the ski under spring tension, and is configured to tilt when subjected to a tilting force to allow the ski bindings to sway, said tilting force being against the spring tension.

In some embodiments, the ski binding system may further comprise at least one bindings support box which supports the bindings support plate via a rod which allows the bindings support plate to tilt with respect to the bindings support box, the bindings support box including a base, a front wall, a rear wall, and side walls, wherein the rod is supported between the front wall and the rear wall. In certain embodiments, a torsion spring is coiled around the rod and is configured to support the bindings support plate in said parallel position to the ski absent a tilting force and to allow the bindings support plate to tilt under said tilting force. In some embodiments, the bindings support plate is attached to the torsion spring via attachment to torsion spring side arms which extend slightly above coils of the torsion spring, and wherein the rod passes through an opening in a front and/or a rear vertical extension wall of the bindings support plate.

In some embodiments, the at least one bindings support plate includes a toe plate to which the toe piece of the bindings is attached and a heel plate to which the heel piece of the bindings is attached, wherein the heel plate and the toe plate are maintained in parallel position to the ski under spring tension and are configured to tilt when subjected to said tilting force. In further embodiments, the at least one bindings support box includes a toe box which supports the toe plate, and a heel box which supports the heel plate, wherein the toe box supports the toe plate via a toe rod which allows the toe plate to tilt with respect to the toe box, the toe box including a base, a front wall, a rear wall, and side walls, wherein the toe rod is supported between the front wall and the rear wall of the toe box; and wherein the heel box supports the heel plate via a heel rod which allows the heel plate to tilt with respect to the heel box, the heel box including a base, a front wall, a rear wall, and side walls, wherein the heel rod is supported between the front wall and the rear wall of the heel box.

In certain embodiments, a first torsion spring is coiled around the toe rod and is configured to support the toe plate in said parallel position to the ski absent a tilting force and to allow the toe plate to tilt under said tilting force, and wherein a second torsion spring is coiled around the heel rod and is configured to support the heel plate in said parallel position to the ski absent a tilting force and to allow the heel plate to tilt under said tilting force. In further embodiments, the toe plate is attached to the first torsion spring via attachment to torsion spring side arms which extend slightly above coils of the first torsion spring, and wherein the toe rod passes through an opening in a front and/or a rear vertical extension wall of the toe plate, and wherein the heel plate is attached to the second torsion spring via attachment to torsion spring side arms which extend slightly above coils of the first torsion spring, and wherein the heel rod passes through an opening in a front and/or a rear vertical extension wall of the heel plate.

In some embodiments, the ski binding system further comprises a base rail in which the toe box and the heel box are supported, wherein the base rail is configured to attached to the ski. In some embodiments, the base rail is configured as a rectangular box.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
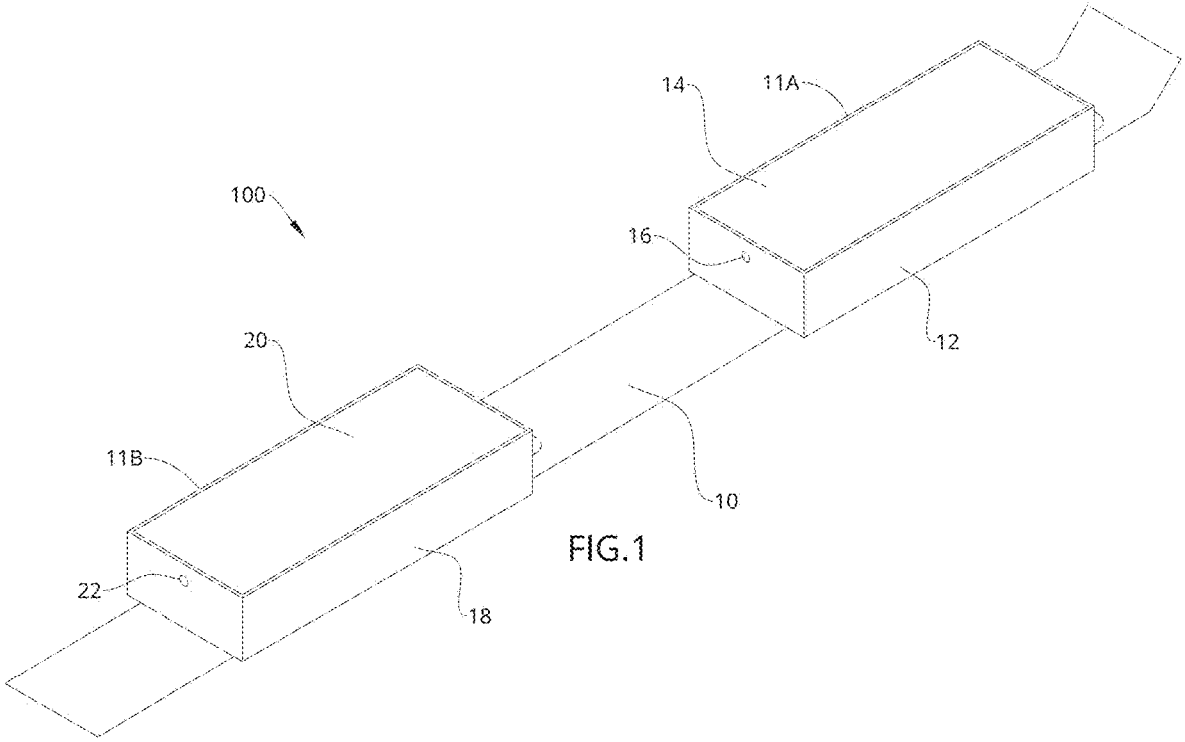
FIG. 1 is a perspective view of a ski bracket system, according to certain embodiments.
Figure 2:
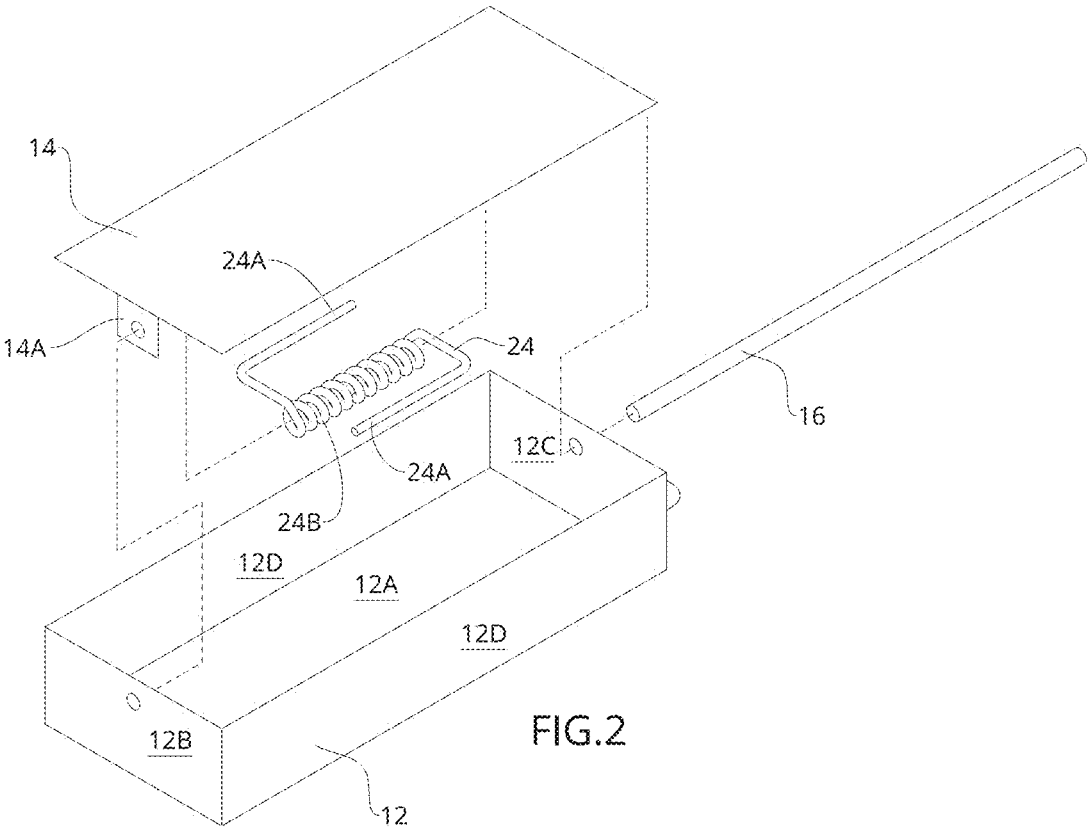
FIG. 2 is an exploded view of a toe binding support of the system.
Figure 3:
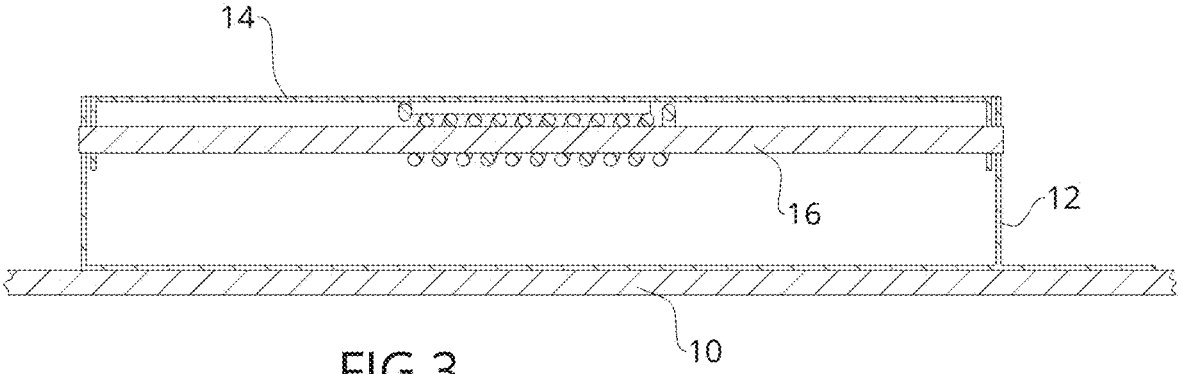
FIG. 3 is a cross section view of the toe binding support.

According to various embodiments as depicted in FIGS. 1-3, disclosed is a ski binding system 100 providing at least one binding support configured to support ski bindings on skis in a manner which allows the bindings to tilt or sway on a spring tensioned platform of the support. In some embodiments, the toe and heel pieces of the bindings may be supported on a single binding support; in other embodiments, the toe and heel biding pieces may be individually supported, i.e., via a toe binding support 11A for the toe piece of the ski bindings, and a heel biding support 11B for the heel piece.

In some embodiments, binding system 100 may optionally include a base rail 10 to which toe binding support 11A and heel biding support 11B may be attach, wherein the base rail 10 may itself be attached to a ski, i.e., via bolting. However, in other embodiments, the binding support(s), i.e., the toe binding support 11A and heel biding support 11B (or single binding support) may be directly attached to the ski.

In some embodiments, toe binding support 11A may include a toe box 12 including a toe box base 12A, a toe box front wall 12B, a toe box rear wall 12C, and toe box side walls 12D. Toe box 12 is generally configured to be supported on base rail 10 or on the top surface of a ski, and further supports a toe plate 14 via a toe plate rod 16 which allows toe plate 14 to tilt with respect to toe box 12. In certain embodiments, a torsion spring 24 is coiled around toe plate rod 16 configured to support toe plate 14 in a neutral/leveled position (i.e. parallel with base rail/toe box base 12A), wherein tilting pressure (during skiing) on the side of the toe plate creates spring resistance while allowing side to side tilting. In certain embodiments, toe plate 14 may be attached to torsion spring 24 via attachment to torsion spring side arms 24A which extend slightly above the coils 24B of torsion spring 24. Additionally, coils 24B may be held in fixed position under friction or other attachment method to rod 16. In further embodiments, toe plate rod 16 may pass through openings 14A in front and rear vertical extension walls in toe plate 14, and is in free rotational engagement therein. Rod 16 may further be engaged through corresponding openings or attachment points in front and rear walls, 12B, 12C, of toe box 12, wherein rod 16 may be held in fixed position via studs, or other suitable attachment means. Thus, torsion spring 24 and toe plate 14 may axially twist with respect to rod 16 under spring tension. In some embodiments, rod 16 may be elevated about 1 cm above the toe box base 12A.

In certain embodiments, heel binding support 11B is configured similarly to toe biding support 11A, and may include a heel box 18 similar to toe box 12. In embodiments, heel box 18 may include a heel box base, a heel box front wall, a heel box rear wall, and heel box side walls, similar to walls 12A-12D in toe box 12. Heel box 18 is generally configured to be supported on base rail 10 or on the top surface of a ski, and further supports a heel plate 20 via a heel plate rod 22 similar to toe plate rod 16 which allows heel plate 20 to tilt with respect to heel box 18. In certain embodiments, a second torsion spring (similar to torsion spring 24) is coiled around heel plate rod 22 and is configured to support heel plate 20 in a neutral/leveled position during skiing (as with the toe box), wherein tilting pressure on the sides of heel plate 20 creates spring resistance while allowing side to side tilting.

In certain embodiments, heel plate 20 may be attached to the second torsion spring via attachment to the torsion spring side arms which extend slightly above the coils of the torsion spring. Additionally, the coils may be held in fixed position under friction or other attachment method to heel plate rod 22. In further embodiments, heel plate rod 22 may pass through openings in front and rear vertical extension walls in heel plate 20, and is in free rotational engagement therein. Rod 22 may further be engaged through corresponding openings or attachment points in front and rear walls of heel box 18, wherein rod 22 may be held in fixed position via studs, or other suitable attachment means. Thus, torsion spring 24 and heel plate 20 may axially twist with respect to rod 22 under spring tension. In some embodiments, rod 22 may be elevated about 1 cm above the base of heel box 18.

In use, the toe bindings piece may be mounted to toe plate 14 and the heel bindings piece may similarly be mounted heel plate 20 via mounting elements such as screws or rivets depending on the brand/type of bindings used. The disclosed system enables a user to adjust the positions of toe box 12/toe plate 14 and heel box 18/heel plate 20, and anchor or bolt these components in place with base rail plate 10 or directly to a ski, to accommodate boot size. In some alternate embodiments, a long box ("bindings support box"), configured similarly to toe box 12 and heel box 18 may provide a single support for both toe and heel binding pieces. In one embodiment, this single biding support may have pre-attached bindings and is configured to accommodate specific standard shoe sizes.

In some embodiments the optional base rail 10 may be an elongated rectangular plate, to which toe box 12 and heel box 18 may be permanently attached (e.g., via bolting). In some other embodiments, base rail 10 may also comprise side walls (so that base rail 10 is structured an open top rectangular box, similar to toe box 12 and heel box 18). Such configuration is designed to retain and guide an alignment of toe binding support 11A and heel binding support 11B in base rail 10. Where base rail 10 is used, toe box 12 and heel box 18 are slightly narrower than base rail 10 to snuggly fit therein. As such, a user may place toe box 12 in base rail 10 and adjust the longitudinal position of toe box 12 within base rail 10 by sliding the toe box back and forth within the base rail plate to adjust for the size of the ski boot. Once the proper position has been determined, the toe and heel boxes may be bolted at their respective bases to base rail 10. In some embodiments, bolt holes may be provided in the bases of the heel box and toe box for this purpose. According to an exemplary embodiment, the optional base rail 10 may be about 60 cm to about 65 cm in length and about 6.5 cm wide. In embodiments wherein base rail is box shaped, vertical walls in base rail may be approximately 1.8 cm high, and toe box 12 and heel box 18 may be slightly narrower, e.g., about 6.3 to about 6.4 cm, and are configured to fit and slide along the length of base rail 10. Toe plate 14 and heel plate 20 are likewise slightly narrower than their respective boxes, e.g., approximately 6.2 cm to about 6.3 cm, such that they fit within toe box 12 and heel box 18, respectively, and tilt therein. In further embodiments, rods 16 and 22 may be approximately 4 mm in diameter. It shall be appreciated however, that the dimensions of these components may vary, depending on the size of the skis.

In one embodiment, springs 24 may be configured to allow for a tilt of approximately 25 degrees in both right and left directions. This angle may be established based on the tension of the springs, and is designed to enable optimal alignment of forces closer to the ski wedge for facilitating turns. It shall be appreciated that the angle of movement and resistance on the torsion springs can be adjusted appropriately to accommodate a user's weight, performance comfort, and individual preference. Thus, the tension springs may offset vibration and enable smoother skiing. Angle of movement promote better ski-snow contact, decrease dragging and improve speed. Additionally, the disclosed system may reduce forces on the tibial plateau, knee joint ligaments, decrease fatigue and reduce risk of injury. In some embodiments, tension adjustment may be effectuated by replacing the springs. In some alternate embodiments, the metal rods may be threaded to incorporate screws which bracket the springs and enable tension adjustment via compression of each spring. It shall be appreciated that different tension adjustment mechanisms may be used in alternate embodiments.

It shall be appreciated that ski binding system 100 and/or components of the disclosed system may have different configurations in alternate embodiments. For example, a different type of spring or otherwise tensioning system may be used to achieve the same results in alternate embodiments. In some embodiments, components of ski biding system 100 may be provided as a kit for assembly by the end user, which may allow for a customized fit. It shall be understood that components of ski system 100 are provided for both right and left side ski bindings and skis. It shall be appreciated that the components of ski binding system 100 may comprise any alternative known materials in the field and be of any size and/or dimensions. It shall further be appreciated that the components of ski binding system 100 may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A ski binding system, comprising:

a binding support configured to support a toe piece and a heel piece of the ski binding system on a ski, wherein the bindings support includes at least one bindings support plate to which the toe piece and the heel piece are configured for attachment, wherein the at least one bindings support plate is maintained in parallel position to the ski under spring tension, and is configured to tilt when subjected to a tilting force to allow the ski bindings to sway, said tilting force being against the spring tension.

2. The ski binding system of claim 1, further comprising at least one bindings support box which supports the bindings support plate via a rod which allows the bindings support plate to tilt with respect to the bindings support box, the bindings support box including a base, a front wall, a rear wall, and side walls, wherein the rod is supported between the front wall and the rear wall.

3. The ski binding system of claim 2, wherein a torsion spring is coiled around the rod and is configured to support the bindings support plate in said parallel position to the ski absent a tilting force and to allow the bindings support plate to tilt under said tilting force.

4. The ski binding system of claim 3, wherein the bindings support plate is attached to the torsion spring via attachment to torsion spring side arms which extend slightly above coils of the torsion spring, and wherein the rod passes through an opening in a front and/or a rear vertical extension wall of the bindings support plate.

5. The ski binding system of claim 1, wherein the at least one bindings support plate includes a toe plate to which the toe piece of the bindings is attached and a heel plate to which the heel piece of the bindings is attached, wherein the heel plate and the toe plate are maintained in parallel position to the ski under spring tension and are configured to tilt when subjected to said tilting force.

6. The ski binding system of claim 5, wherein the at least one bindings support box includes a toe box which supports the toe plate, and a heel box which supports the heel plate, wherein the toe box supports the toe plate via a toe rod which allows the toe plate to tilt with respect to the toe box, the toe box including a base, a front wall, a rear wall, and side walls, wherein the toe rod is supported between the front wall and the rear wall of the toe box; and wherein the heel box supports the heel plate via a heel rod which allows the heel plate to tilt with respect to the heel box, the heel box including a base, a front wall, a rear wall, and side walls, wherein the heel rod is supported between the front wall and the rear wall of the heel box.

7. The ski binding system of claim 6, wherein a first torsion spring is coiled around the toe rod and is configured to support the toe plate in said parallel position to the ski absent a tilting force and to allow the toe plate to tilt under said tilting force, and wherein a second torsion spring is coiled around the heel rod and is configured to support the heel plate in said parallel position to the ski absent a tilting force and to allow the heel plate to tilt under said tilting force.

8. The ski binding system of claim 7, wherein the toe plate is attached to the first torsion spring via attachment to torsion spring side arms which extend slightly above coils of the first torsion spring, and wherein the toe rod passes through an opening in a front and/or a rear vertical extension wall of the toe plate, and wherein the heel plate is attached to the second torsion spring via attachment to torsion spring side arms which extend slightly above coils of the first torsion spring, and wherein the heel rod passes through an opening in a front and/or a rear vertical extension wall of the heel plate.

9. The ski binding system of claim 7, further comprising a base rail in which the toe box and the heel box are supported, wherein the base rail is configured to attached to the ski.

10. The ski binding system of claim 7, wherein the base rail is configured as a rectangular box.

* * * * *